US010659883B2

(12) United States Patent
Xiao et al.

(10) Patent No.: US 10,659,883 B2
(45) Date of Patent: May 19, 2020

(54) MAGNETIC BOWL AND SOUNDING DEVICE

(71) Applicant: AAC Technologies Pte. Ltd., Singapore (SG)

(72) Inventors: Bo Xiao, Shenzhen (CN); Ronglin Linghu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/233,367

(22) Filed: Dec. 27, 2018

(65) Prior Publication Data

US 2019/0246211 A1 Aug. 8, 2019

(30) Foreign Application Priority Data

Feb. 2, 2018 (CN) ..... 2018 1 0108486

(51) Int. Cl.

| | |
|---|---|
| ***H04R 9/06*** | (2006.01) |
| ***H04R 9/02*** | (2006.01) |
| ***H04R 9/04*** | (2006.01) |
| ***H04R 7/02*** | (2006.01) |

(52) U.S. Cl.

CPC ..... *H04R 9/06* (2013.01); *H04R 7/02* (2013.01); *H04R 9/025* (2013.01); *H04R 9/04* (2013.01); *H04R 2400/11* (2013.01); *H04R 2499/11* (2013.01)

(58) Field of Classification Search

CPC ..... H04R 15/00; H04R 7/02; H04R 9/025; H04R 9/04; H04R 9/06; H04R 2400/11; H04R 2499/11; H04R 7/18

See application file for complete search history.

(56) References Cited

U.S. PATENT DOCUMENTS

| | | | | |
|---|---|---|---|---|
| 5,014,321 | A * | 5/1991 | Klein | H04R 15/00 381/111 |
| 6,239,948 | B1 * | 5/2001 | Wu | G11B 5/235 360/119.11 |
| 2004/0218779 | A1 * | 11/2004 | Fukuyama | H04R 1/06 381/409 |
| 2006/0291344 | A1 * | 12/2006 | Qiu | G11B 7/0932 369/44.15 |
| 2014/0376766 | A1 * | 12/2014 | Chen | H04R 9/02 381/400 |
| 2018/0261375 | A1 * | 9/2018 | Chou | H01F 41/0246 |

* cited by examiner

*Primary Examiner* — Fan S Tsang
*Assistant Examiner* — Angelica M McKinney
(74) *Attorney, Agent, or Firm* — IPro, PLLC; Na Xu

(57) ABSTRACT

The present disclosure provides a magnetic bowl, including: a main body made of a first magnetic material and a reinforcing portion made of a second magnetic material, wherein the reinforcing portion is superposed and fixed on the main body, and the second magnetic material has a higher magnetoconductivity than the first magnetic material. The present disclosure further provides a sounding device using the magnetic bowl. Compared with the related art, the magnetic bowl of the present disclosure has a simple forming process and low production cost, and the sounding device using the magnetic bowl has excellent acoustic performance.

8 Claims, 6 Drawing Sheets

MAGNETIC BOWL AND SOUNDING DEVICE

CROSS-REFERENCE TO RELATED APPLICATIONS

The present application claims priority to Chinese Patent Application No. 201810108486.9 filed on Feb. 2, 2018, the content of which is incorporated herein by reference in its entirety.

TECHNICAL FIELD

The present disclosure relates to the acoustic and electrical field and, in particular, to a magnetic bowl and a sounding device using the magnetic bowl.

BACKGROUND

With the advent of the mobile Internet era, the number of smart mobile devices continues to rise. Among various mobile devices, cellphones are undoubtedly the most common and portable mobile terminal devices. Sounding devices for playing sounds are nowadays widely used in smart mobile devices, such as cellphones.

In the related art, a sounding box includes a frame, a vibration system that is supported by and fixed to the frame, and a magnetic circuit unit that is supported by and fixed to the frame for driving the vibration system to vibrate. The magnetic circuit unit includes a magnetic bowl (also called yoke) fixed to the frame and a magnet that is supported by and fixed to the magnetic bowl.

However, in the related art, magnetic components such as the magnetic bowl of the sounding device are all formed using a same magnetic material, and the magnetoconductivity of this ordinary magnetic material has been already saturated, and it is necessary to use a magnetic material with a higher magnetoconductivity to achieve the purpose of increasing the magnetoconductivity, in order to achieve the purpose of further improving the acoustic performance of the sounding device. However, the better the magnetoconductivity of the material is, the higher the hardness of the material is. An operation such as ordinary stretching and the like cannot be implemented during a punching process and a crack may occur.

Therefore, it is necessary to provide a new magnetic bowl and a sounding device to solve the above technical problems.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, other drawings can also be acquired by those skilled in the art based on those drawings without paying creative efforts.

DESCRIPTION OF EMBODIMENTS

In order to make the purpose, technical solutions, and advantages of the embodiments of the present disclosure to be understandable, the technical solutions in the embodiments of the present disclosure are described in the following with reference to the accompanying drawings. It should be understood that the described embodiments are merely a part of embodiments of the present disclosure, but not all of the embodiments of the present disclosure. All other embodiments obtained by those skilled in the art based on the embodiments of the present disclosure without creative efforts are within the protection scope of the present disclosure.

Figure 1:
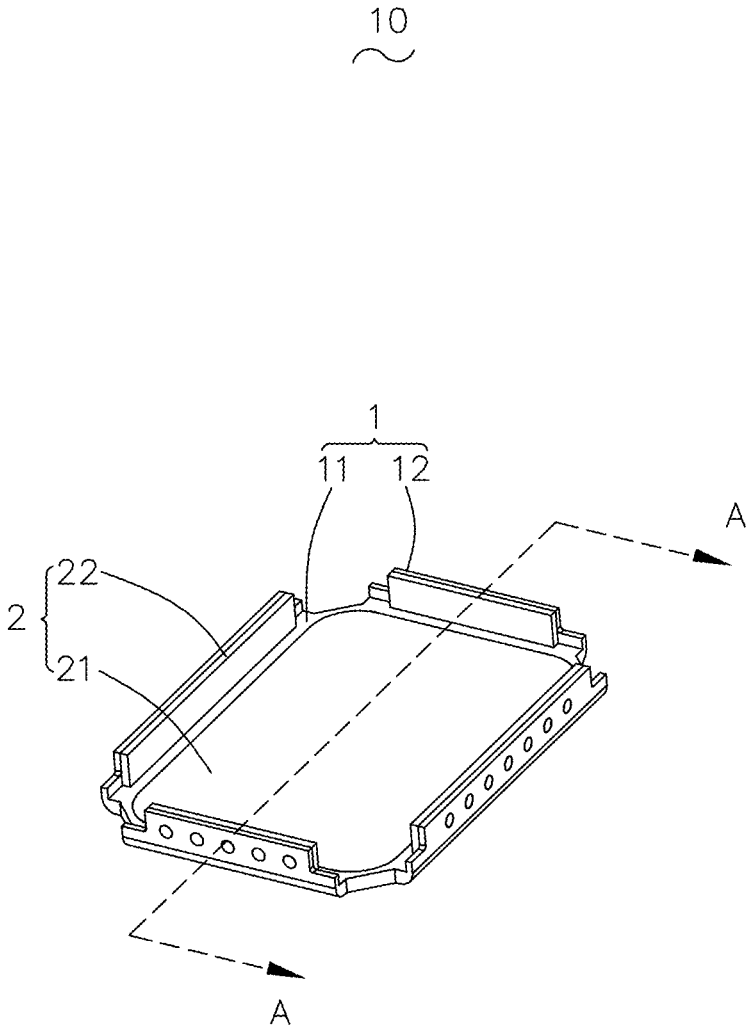
FIG. 1 is a schematic perspective view of a magnetic bowl according to an embodiment of the present disclosure.
Figure 2:
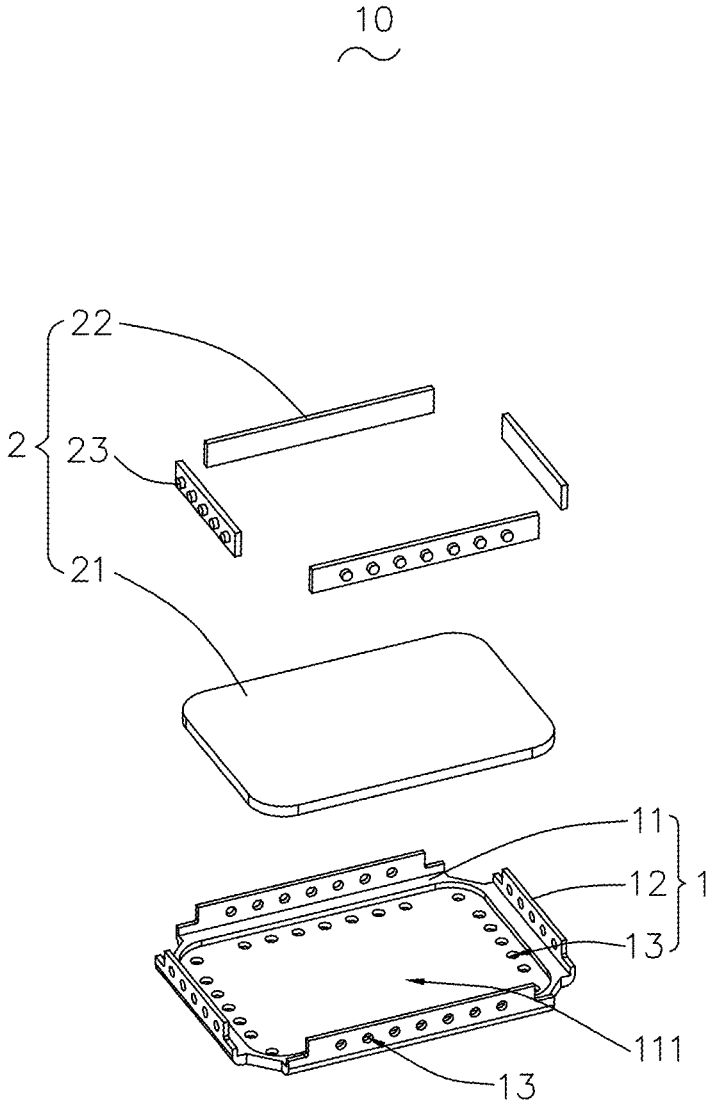
FIG. 2 is a schematic exploded perspective view of a magnetic bowl according to an embodiment of the present disclosure.
Figure 3:
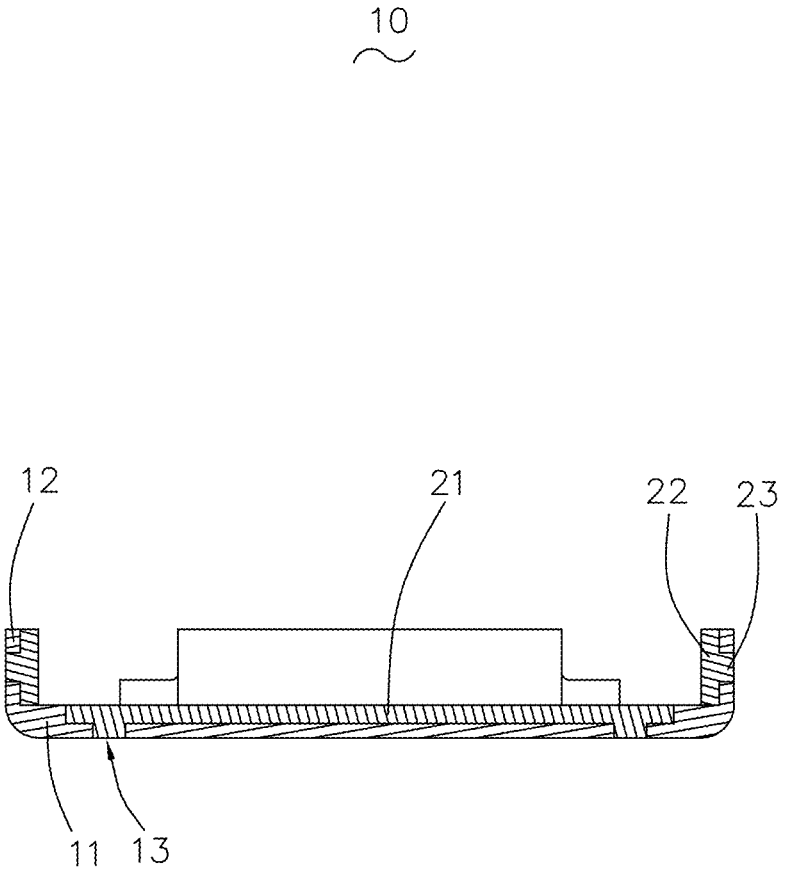
FIG. 3 is a cross-sectional view along line A-A of FIG. 1.

With reference to FIGS. 1-3, an embodiment of the present disclosure provides a magnetic bowl 10. The magnetic bowl 10 includes a main body 1 and a reinforcing portion 2. The reinforcing portion 2 is attached and fixed to the main body 1 to form an integral structure. For example, the reinforcing portion 2 is fixed to main body 1 by riveting or laser welding so as to form an integral structure.

The main body 1 is made of a first magnetic material, and the reinforcing portion 2 is made of a second magnetic material. The second magnetic material has a higher magnetoconductivity than the first magnetic material.

It should be noted that although the second magnetic material has a higher magnetoconductivity, its hardness is relatively high, that is, it is not easy to be stretched during processing. Therefore, in the magnetic bowl 10 of the present disclosure, the reinforcing portion 2 made of the second magnetic material is mainly a structure that is easy to be formed, such as a flat plate-like structure, and the reinforcing portion 2 is arranged in a region of the main body 1 where the performance of the main body 1 is easily affected and where the shape is easily formed. In this way, it not only facilitates forming, but also effectively improves the magnetoconductivity of the magnetic bowl 10.

In this embodiment, the first magnetic material is a common magnetic material forming the magnetic bowl structure in the related art, and the second magnetic material is a nickel-cobalt alloy, for example, HiperCo 15, or HiperCo 27, or HiperCo 30, or HiperCo 50 and so on.

In order to increase the magnetoconductivity of the magnetic bowl 10 as much as possible, in this embodiment, the reinforcing portion 2 is fixed to a region of the main body 1 where the performance of the main body 1 is easily affected.

Specifically, the main body 1 includes a bottom wall 11 and a side wall 12 that is bent with respect to bottom wall 11 and extends from the bottom wall 11. Since the main body 1 is formed by the first magnetic material, i.e., made of a common magnetic material in the related art, the processing and forming thereof are not difficult, the processing is simple and the forming is easy, and thus the production cost is reduced.

In this embodiment, the main body 1 has four side walls 12 and the four side walls 12 are spaced from one another. For example, the magnetic bowl 10 has a rectangular shape, and the four side walls 12 are formed by extending of four edges of the bottom wall 11, respectively.

The reinforcing portion 2 includes at least one of a bottom wall reinforcing portion 21 and a side wall reinforcing portion 22. In an embodiment, the reinforcing portion 2 includes a bottom wall reinforcing portion 21 and a side wall reinforcing portion 22.

The bottom wall reinforcing portion 21 is engaged with the bottom wall 11 and is fixed and attached onto an inner surface of the bottom wall 11. The side wall reinforcing portion 22 is engaged with the side wall 12 and is fixed and attached onto an inner surface of the side wall 11. The fixing manner is not limited, and riveting, laser welding, structural fit clamping and the like are all feasible.

In one embodiment, specifically, the bottom wall 11 and the side wall 12 each include fixing holes 13 formed therein, and the bottom wall reinforcing portion 21 and the side wall reinforcing portion 22 each include fixing pillars 23 formed thereon. The bottom wall reinforcing portion 21 is fixed to the bottom wall 11 in a manner that the fixing pillars 23 are locked in the fixing holes 13 of the bottom wall 11; the side wall reinforcing portion 22 is fixed to the side wall 12 in a manner that the fixing pillars 23 are locked in the fixing holes 13 of the side wall 12. In this way, an integral structure is formed after assembling.

In one embodiment, for saving occupied volume, the bottom wall 11 further includes an accommodating groove 111 recessed from a surface of the bottom wall 11 close to the bottom wall reinforcing portion 21 toward a side of the bottom wall 11 away from the bottom wall reinforcing wall 21. The fixing holes 13 of the bottom wall 11 penetrate through the accommodating groove 111, and the bottom wall reinforcing portion 21 is accommodated and fixed in the accommodating groove 111. With such configuration, the bottom wall reinforcing portion 21 will not occupy too much space of the magnetic bowl 10.

Figure 4:
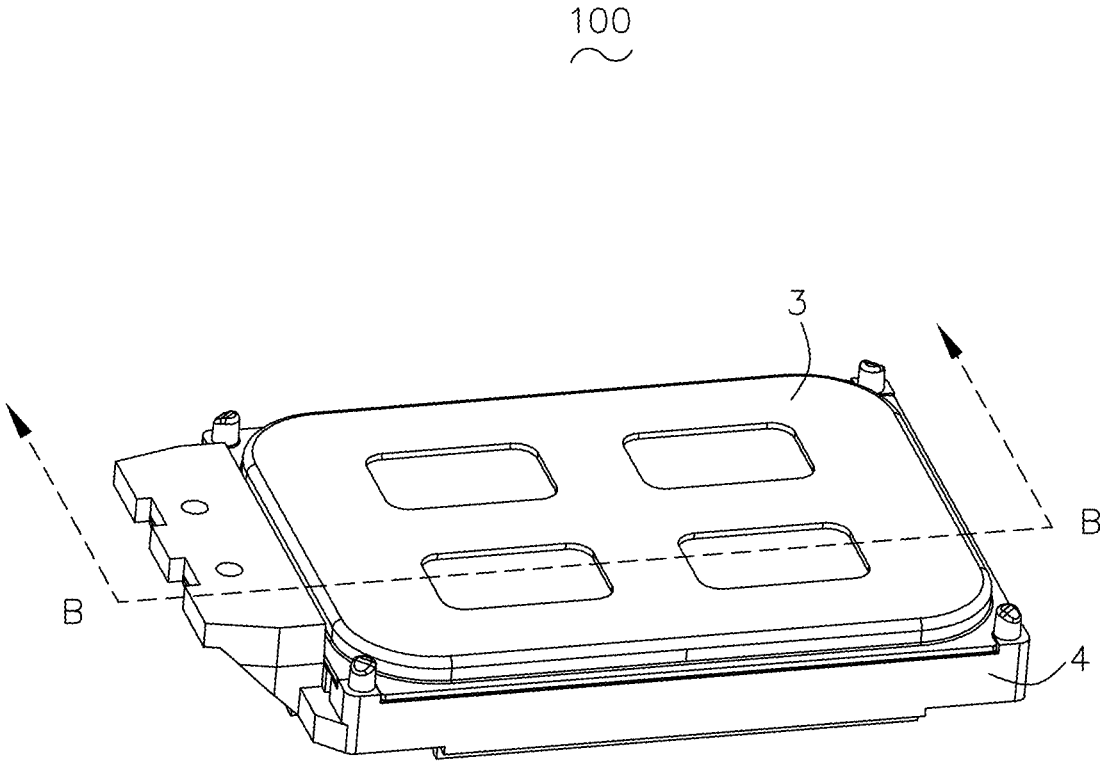
FIG. 4 is a sounding device according to an embodiment of the present disclosure.
Figure 5:
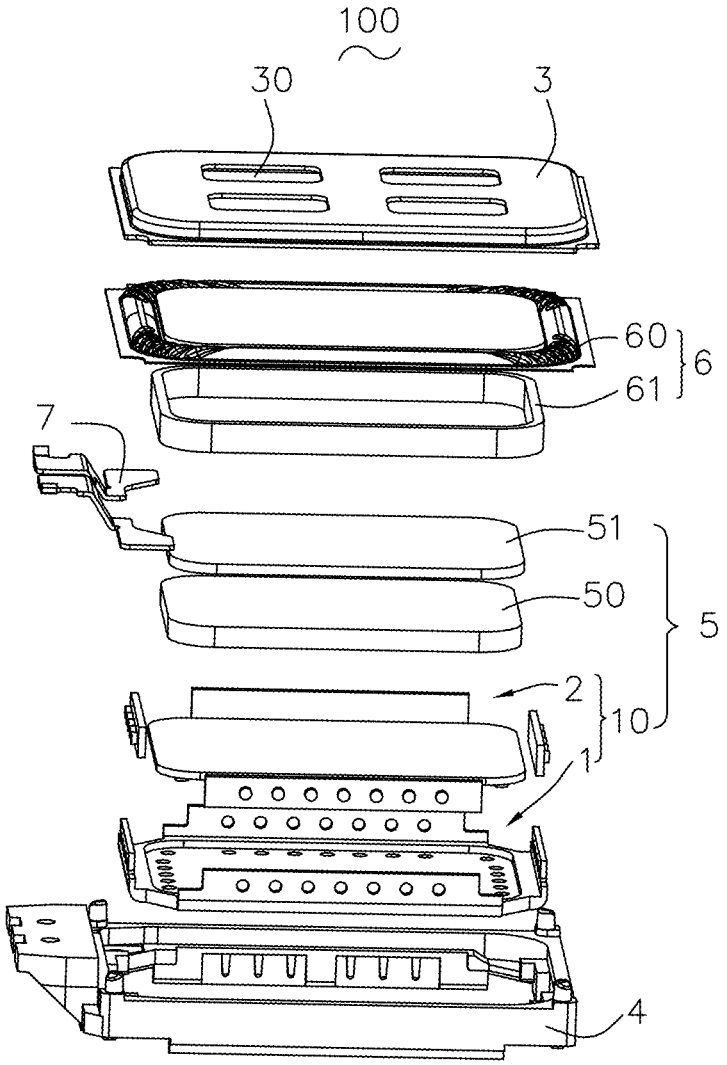
FIG. 5 is an exploded view of the sounding device of FIG. 4.
Figure 6:
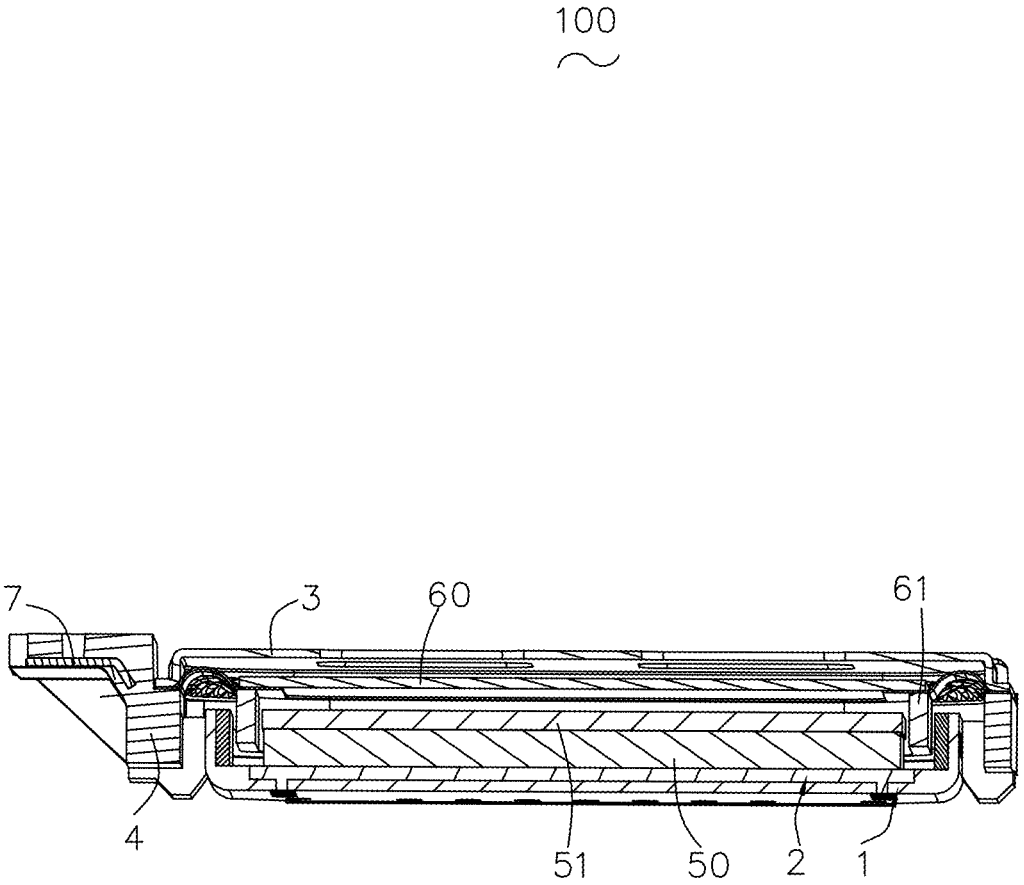
FIG. 6 is a cross-sectional view along line B-B of the sounding device of FIG. 4.

With reference to FIGS. 4-6, an embodiment of the present disclosure provides a speaker 100. The speaker 100 includes a frame 4, a vibration system 6 disposed in the frame 4, a magnetic circuit unit 5 disposed in the frame 4, a front cover 3 covering the frame 4, and an electroconductive terminal 7 embedded in the frame 4. The magnetic circuit unit 5 is used to drive the vibration system 6 to vibrate and sound.

The vibration system 6 includes a diaphragm 60 interposed between the frame 4 and the front cover 3, and a voice coil 61 that is fixed to the diaphragm 60 at one end and is used to drive the diaphragm 60 to vibrate and sound.

The magnetic circuit unit 5 includes a magnetic bowl 10 fixed to the frame 4, and a magnet 50 that is assembled to the magnetic bowl 10 to form a magnetic gap. A specific structure of the magnetic bowl 10 is the same as that described above, and will not be further described herein.

The electroconductive terminal 7 is configured to be electrically connected to the outside, and two electroconductive terminals 7 are provided in the speaker 100. The electroconductive terminal terminals are embedded in the frame 4 and are electrically connected to the voice coil 61.

Compared with the related art, the magnetic bowl of the present disclosure includes the main body made of the first magnetic material and the reinforcing portion made of the second magnetic material, the reinforcing portion is fixed and attached to the main body, and the magnetoconductivity of the second magnetic material is higher than the magnetoconductivity of the first magnetic material; the reinforcing portion is arranged in a region where the performance of the magnetic bowl is easily effected and where the shape is easily formed, and the remaining components are made of the common first magnetic material. In this way, a magnetic bowl structure that is simply formed and has a high magnetoconductivity is achieved; when the magnetic bowl is used in the sounding device, its high magnetoconductivity greatly improves the acoustic performance of the sounding device, and processing thereof is simple.

It should be noted that, the above are merely embodiments of the present disclosure, which shall not be interpreted as limitations to the present disclosure. All other embodiments obtained by those skilled in the art without creative efforts according to the embodiments of the present disclosure are within the protection scope of the present disclosure.

What is claimed is:

1. A magnetic bowl, comprising:

a main body made of a first magnetic material, and a reinforcing portion made of a second magnetic material, wherein the reinforcing portion is superposed and fixed on the main body, and the second magnetic material has a higher magnetoconductivity than the first magnetic material;

the main body comprising a bottom wall and a side wall that bent with respect to the bottom wall and extending from the bottom wall, the reinforcing portion comprising a bottom wall reinforcing portion and/or a side wall reinforcing portion, the bottom wall reinforcing portion fixed and attached to an inner surface of the bottom wall to increase the thickness of the bottom wall, and the side wall reinforcing portion fixed and attached to an inner side of the side wall to increase the thickness of the side wall.

2. The magnetic bowl as described in claim 1, wherein the reinforcing portion is fixed to the main body by riveting or laser welding.

3. A sounding device, comprising a vibration system and a magnetic circuit unit configured to drive the vibration system to vibrate and sound, wherein the magnetic circuit unit comprises the magnetic bowl according to claim 2.

4. The magnetic bowl as described in claim 3, wherein each of the bottom wall and the side wall has a fixing hole formed therein, each of the bottom wall reinforcing portion and the side wall reinforcing portion comprises a fixing pillar formed thereon, the bottom wall reinforcing portion is fixed to the bottom wall in a manner that the fixing pillar of the bottom wall reinforcing portion is locked in the fixing hole of the bottom wall, and the side wall reinforcing portion is fixed to the side wall in a manner that the fixing pillar of the side wall reinforcing portion is locked in the fixing hole of the side wall.

5. The magnetic bowl as described in claim 4, wherein the bottom wall further comprises an accommodating groove recessed from a side of the bottom wall close to the bottom wall reinforcing portion towards a side of the bottom wall away from the bottom wall reinforcing wall, the fixing hole of the bottom wall penetrates through the accommodating groove, and the bottom wall reinforcing portion is accommodated and fixed in the accommodating groove.

6. The magnetic bowl as described in claim 1, wherein four side walls are provided, and the four side walls are spaced from one another.

7. The magnetic bowl as described in claim 1, wherein the second magnetic material is a nickel cobalt alloy.

8. A sounding device, comprising a vibration system and a magnetic circuit unit configured to drive the vibration system to vibrate and sound, wherein the magnetic circuit unit comprises the magnetic bowl according to claim 1.

* * * * *